US005404622A

United States Patent [19]

Sato

[11] Patent Number: 5,404,622

[45] Date of Patent: Apr. 11, 1995

[54] CORNER CLIPS AND CORNER CLIPPING APPARATUS

[76] Inventor: Hisao Sato, Fujimidai-Mansion 2002, 29-10, Nukui 1-Chome, Nerima-ku, Tokyo, Japan

[21] Appl. No.: 165,891

[22] Filed: Dec. 14, 1993

[51] Int. Cl.[6] ..... B42F 1/12

[52] U.S. Cl. ..... 24/67 CF; 24/67 R; 24/67.9

[58] Field of Search ..... 24/67 CF, 67 R, 67.9, 24/67.3, 545, 546; 40/158.1

[56] References Cited

U.S. PATENT DOCUMENTS

| | | | |
|---|---|---|---|
| 524,647 | 8/1894 | Pancoast | 24/67 CF |
| 768,313 | 8/1904 | Scherf | 24/67 CF |
| 1,236,336 | 8/1917 | Merrill | 24/67 CF |
| 1,423,520 | 7/1922 | Freedman | 24/67 CF |
| 2,853,043 | 9/1958 | Bitterman et al. | 24/67 CF |
| 3,137,934 | 6/1964 | Rhoads | 24/67.9 |
| 5,272,792 | 12/1993 | Harper | 24/67 CF |

FOREIGN PATENT DOCUMENTS

| | | | |
|---|---|---|---|
| 0003649 | 3/1901 | Australia | 24/67 CF |

*Primary Examiner*—Victor N. Sakran
*Attorney, Agent, or Firm*—Kanesaka & Takeuchi

[57] ABSTRACT

A corner clip for clipping a plurality of sheets of documents or the like at their corner part without piercing the documents or the like, is made from a strip of bendable metallic material with a predetermined width, has an approximately trapezoidal substrate part and a pair of leg parts which are bent at approximate right angles from a pair of mutually slanted edge parts of this substrate part. In case after these leg parts are applied to outer edges of the corner part of the documents when the documents are to be bound, the leg parts are bent toward back side so that the substrate part of the corner clip presses the uppermost document from its surface side and the pair of legs press the lowermost document from its back surface side.

7 Claims, 13 Drawing Sheets

CORNER CLIPS AND CORNER CLIPPING APPARATUS

BACKGROUND OF THE PRESENT INVENTION

1. Field of the Invention

The present invention relates to clips which are designed to bind together a plurality of documents or slips, and to a clipping apparatus which is designed to fasten these clips to the documents or slips. More particularly, the present invention relates to corner clips which are designed to bind a plurality of documents or slips at the corner part thereof without piercing them, and to a corner clipping apparatus which is designed to fasten these corner clips to the corner part of the documents or slips.

2. Description of the Related Art

In the case of binding together a plurality of documents or slips, in order to conduct binding so that they are easy to turn over and so that photocopies are easy to make, it is preferable to bind the corner part of the documents or slips. At such times, the conventional method has been to bind the corner part with a staple by using a stapler, or to conduct binding by piercing an eyelet through the corner part.

Yet, since the diameter of the staple of the stapler is small in section and short in length, it often happens that during the repeated bending of the documents by the staple, first, the topmost document is gradually torn along the staple from the hole parts which are formed by the perforations of the staple, and finally a narrow hole with a length equal to the length of the staple is created so that the topmost document comes off from this hole. On the other hand, in the case of the eyelet, it is necessary to open a comparatively large hole in the documents, and since the form of the hole is circular, when the documents are bent from the part which contacts of the periphery of the eyelet, the documents are torn from this contact part, and they easily come off from the topmost document upon repeated bending.

SUMMARY OF THE INVENTION

It is therefore an object of the present invention to provide corner clips which are able to bind a plurality of documents or slips at the corner part thereof without injuring the documents and without having the documents come off easily in the above manner, and a corner clipping apparatus which is designed to fasten these corner clips to the corner part of the documents or slips.

The corner clip according to the present invention is made from a strip of bendable metallic material having a predetermined width. The corner clip includes an approximately trapezoidal substrate part, and a pair of legs which are bent at approximate right angles from the mutually slanted pair of edges of this substrate part.

This corner clip is applied so that the corner part of the documents which have been collected into a plurality of sheets fits into between the leg parts which face opposite to one another. By further bending the leg parts to the back side of the documents, the clip substrate part presses the topmost document from its surface side while the pair of leg parts press the lowermost document from its back surface. As a result of this bend in the leg parts, the interposed documents can be integrally bound without inflicting any damage to them. Once the documents are in a clipped state, the long rear edge of the substrate part serves as a guide when the documents are to be bent so that the bending of the document can be easily conducted.

The corner clipping apparatus, which is designed to be used in combination with the above-mentioned corner clip to bind the corner of the documents, comprises: a base having a pair of guide plate members for positioning the corner part at an approximately central part between the pair of guide plate members, and a pair of bending grooves positioned near top ends of the pair of guide plate members for bending the leg parts in the direction so that the leg parts contact with each other; a hammer member having a cross section so that the hammer member comes into face-to-face contact with the substrate part of the corner clip; a frame member attached on the base for supporting the hammer member so that the hammer member is vertically movable to and from the bending grooves; and a handle rotatably attached to the frame member for vertically moving the hammer member, whereby the leg parts of the corner clip are bent along the pair of bending grooves by means of the hammer member.

Thus, since this corner clipping apparatus has the pair of bending grooves near the respective top portions of the pair of guide plate members, the corner part of the documents to be clipped is inserted into between the guide plate members; after the corner clip is positioned so that the corner part of the documents is interposed between the leg parts, the handle is lowered which brings down the hammer member so that the hammer member contacts the top of the substrate part of the corner clip, presses the lower ends of the leg parts to the bending grooves, and bends them along the bending groove surfaces. By this bending, the lower ends of the leg parts are positioned on the underside of the bottommost document, and the corner part of the documents can thereby be firmly clipped.

Other objects and advantages of the present invention will become apparent from the following description of the preferred embodiments of the present invention with reference to the accompanying drawings.

DESCRIPTION OF THE PREFERRED EMBODIMENTS

Figure 1:
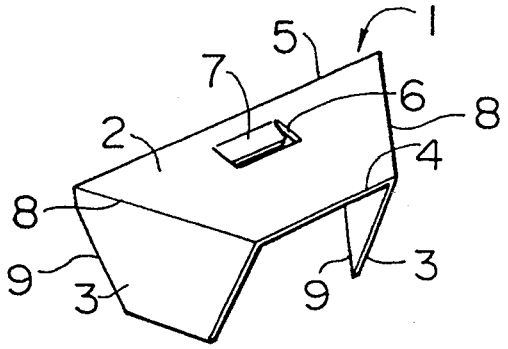
FIG. 1 is a perspective view showing an embodiment of the corner clip according to the present invention.

Below, the present invention will be described with regard to embodiments which are illustrated in the drawings. First, an embodiment of the corner clip is described with reference to FIGS. 1 and 2. A corner clip 1 is a bendable metallic material such as stainless steel, iron, or aluminum steel which is punched into a strip having a predetermined width, and then bent. This corner clip 1 has an approximately trapezoidal substrate part 2 which is positioned roughly at the center of the strip, and a pair of leg parts 3 which are bent at approximate right angles from a pair of mutually slanted edge parts 8 of this substrate part 2. With regard to another pair of edges of this substrate part 2 which face each other in a mutually parallel manner, the shorter edge constitutes a front edge part 4 which is to be positioned at the corner part of documents, while the longer edge constitutes a rear edge part 5 which becomes the bending guide for the documents. In this substrate part 2, an approximately dish-shaped cut part 6 is formed near the center of the rear edge part 5, and a fastener 7 is provided by inclining downward the severed portion of this cut part 6. With regard to each of the leg parts 3, the edge along the edge part 8 is long, while the length of the forward edge is short, so that the leg part 3 roughly forms a reverse trapezoid. Moreover, in order that the rear edge side of the leg part 3 does not project outward from the rear edge part 5 of the substrate part 2 even when the leg part 3 is bent to the bottom side of the substrate part 2, the leg part 3 has a slanted edge 9 which was formed by cutting it diagonally.

Accordingly, by conducting application so that the corner part to be clipped of the documents which have been collected into a plurality of sheets fits into between the leg parts 3 which face opposite to one another, and by bending the leg parts 3 to the back surface side of the documents, the substrate part 2 of the corner clip 1 presses the topmost document from its front surface side while the pair of leg parts 3 presses the bottommost document from its back surface side, so that the documents which are held by the substrate part 2 and the leg parts 3 can be integrally clipped without receiving any damage whatsoever by the bending of the leg parts 3. Once the documents are in the clipped state, the long rear edge part 5 of the substrate part 2 serves as a guide when bending the documents so that bending can be easily conducted.

Figure 2:
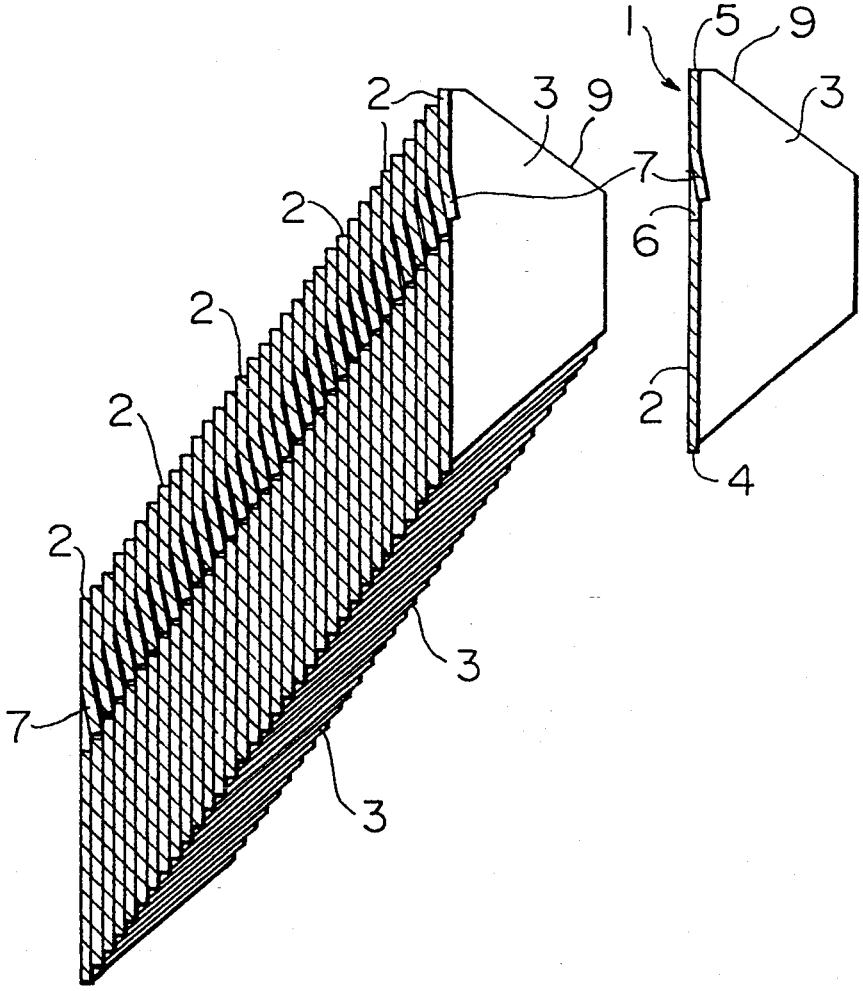
FIG. 2 is a sectional view showing the corner clip of FIG. 1 in a state where a plurality of such corner clips have been collected.

As shown by FIG. 2, by placing another corner clip 1 on top of the corner clip 1, the fastener 7 of the upper corner clip 1 engages with the cut part 6 of the lower corner clip 1, and is able to prevent the lower corner clip 1 from falling off. Accordingly, when a plurality of corner clips 1 is piled to place one on top of the other, these corner clips 1 can be lifted without holding all of them so that handling is easy.

Next, an embodiment of the corner clipping apparatus which is designed to bind the corner part of documents with the corner clip 1 formed in the above manner will be described with reference to FIG. 3 to FIG. 12. In the below description, the words "front" and "rear" refer to the left and right sides respectively in FIG. 3.

Figure 3:
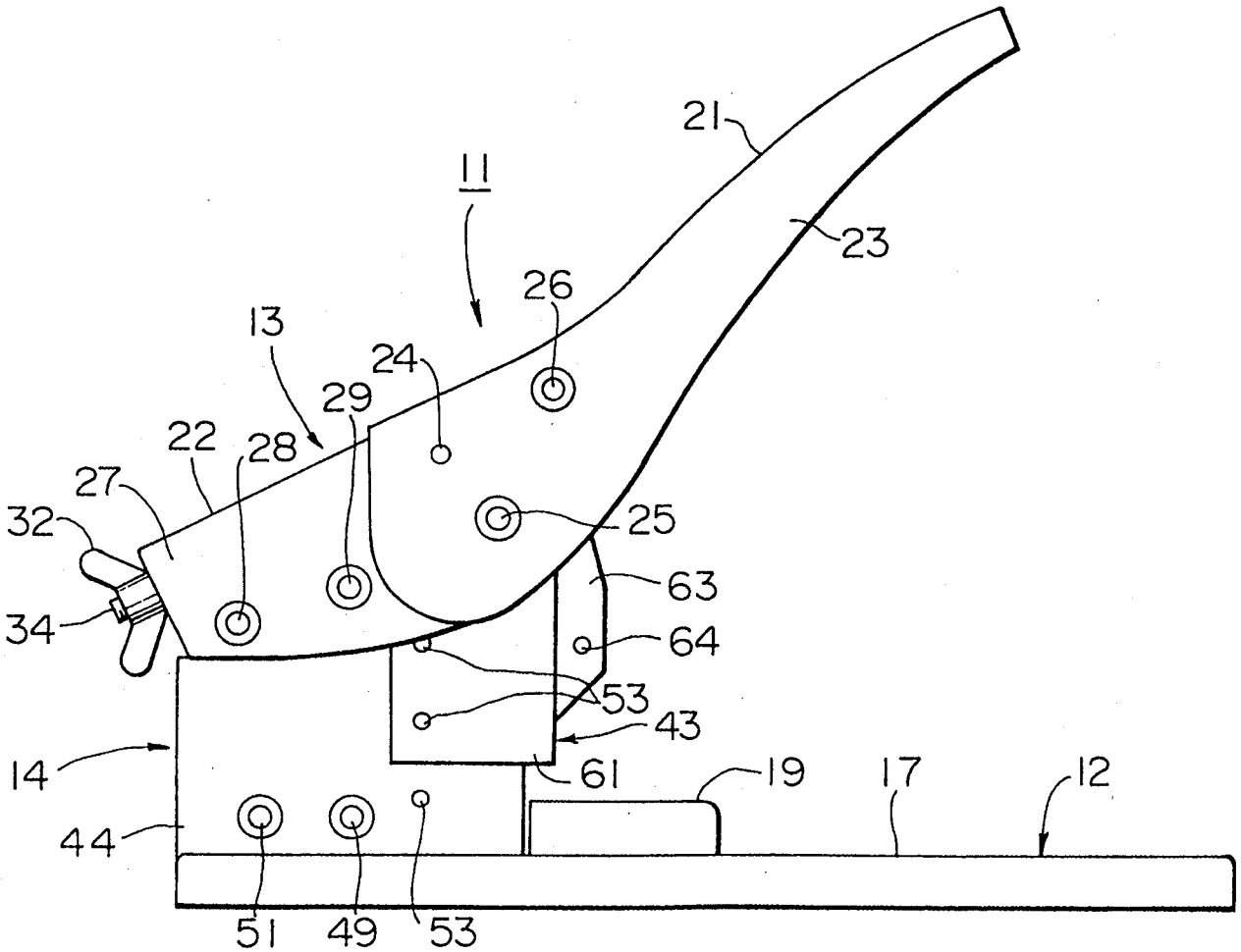
FIG. 3 is a front view showing an embodiment of the corner clipping apparatus according to the present invention.

As may be seen in FIG. 3 which shows the external appearance, a corner clipping apparatus 11 is constituted by three main members of a base 12, a handle 13, and a support frame 14 which supports this handle 13 so as to allow the handle 13 to make pivotal movement and which supports members for bending the leg parts 3 of the corner clip 1.

Figure 4:
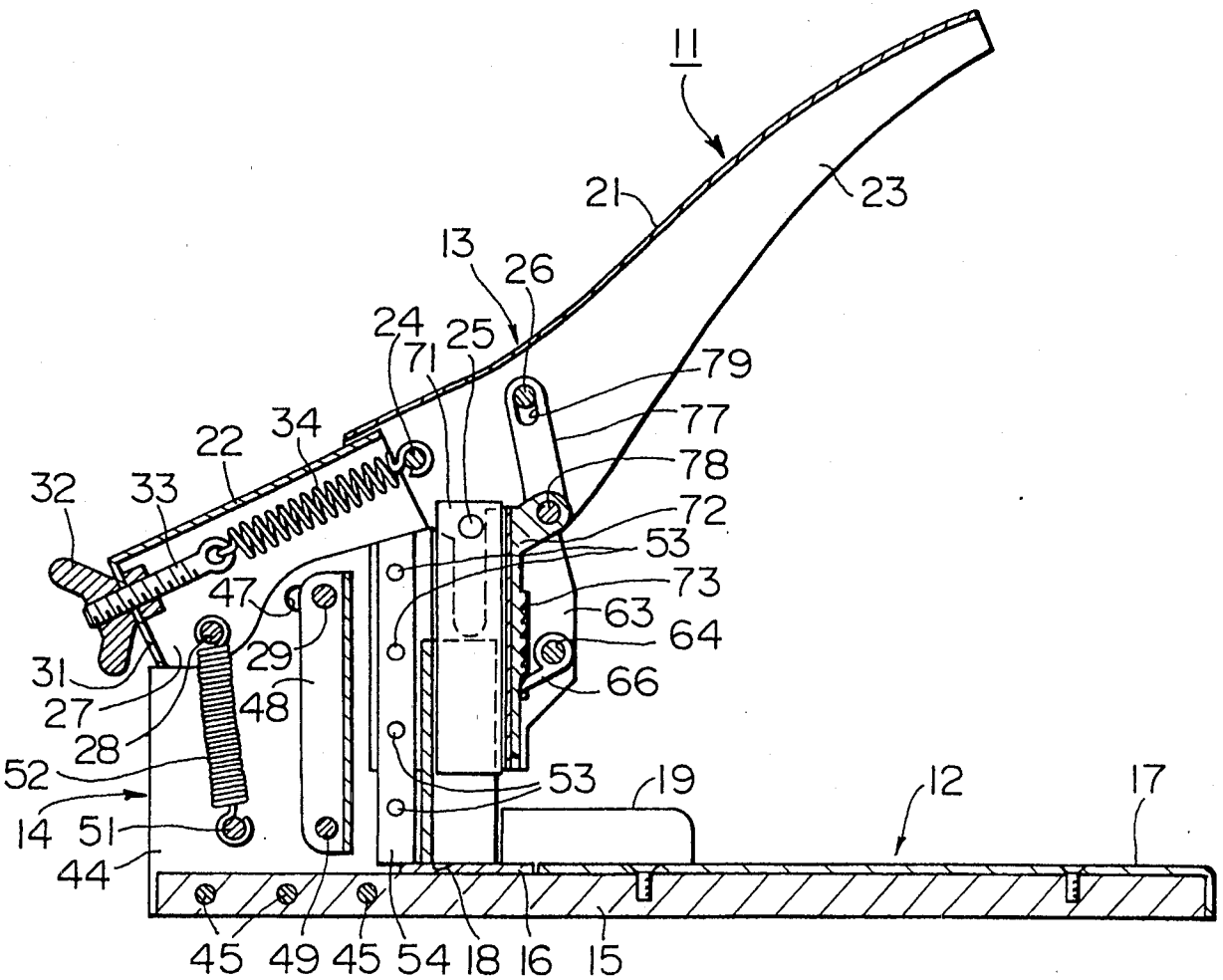
FIG. 4 is a vertical sectional view of the corner clipping apparatus of FIG. 3.
Figure 5:
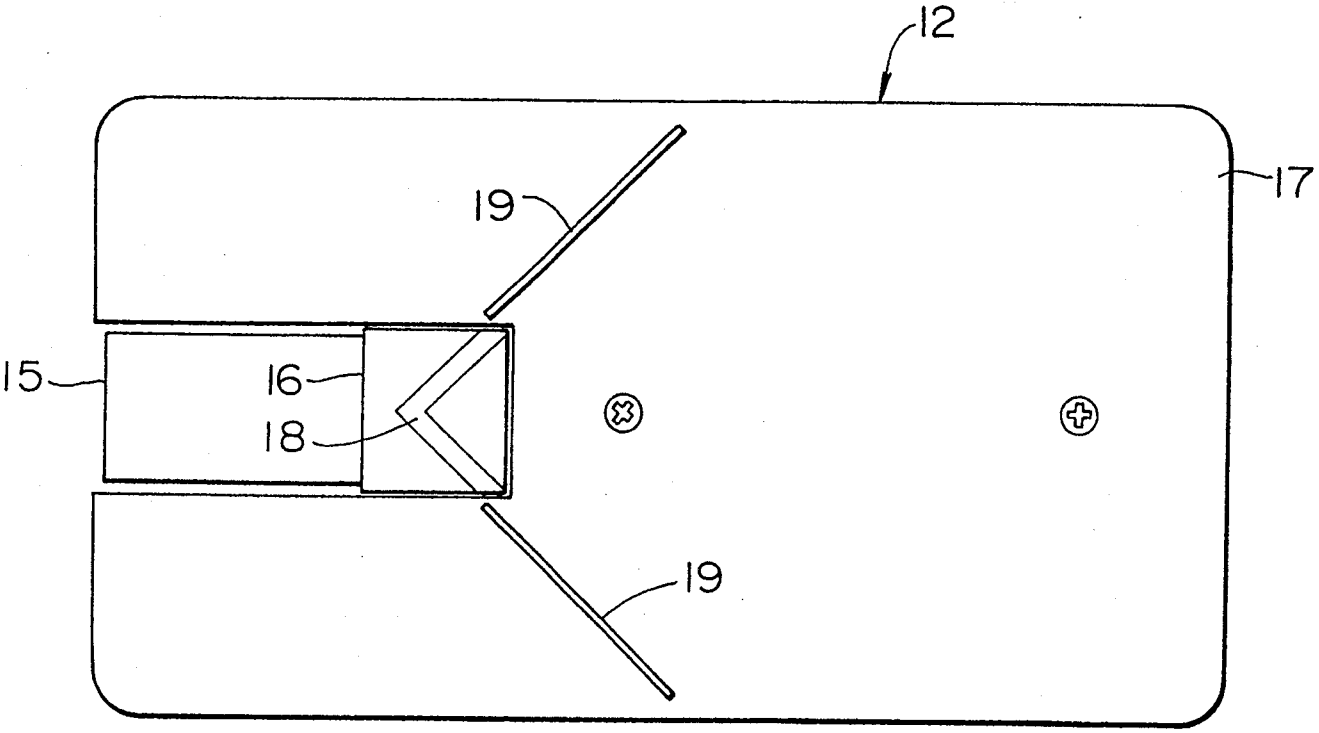
FIG. 5 is a plan view showing only a substrate of the corner clipping apparatus of FIG. 3.

As shown in FIG. 5, the base 12 is constituted by a central base 15 which is made from an elongated metal body of iron or cast metal, a bending base 16 which is made from the same type of metal body and which is fastened on top of this central base 15, and a cover 17 which covers the top of the central base 15 but leaves exposed part of the central base 15 on a side of the bending base 16. This cover 17 may be constituted by a metallic plate or a synthetic resin plate. On the top surface of the bending base 16, bending grooves 18 are formed at approximate right angles so that the apex of the bending grooves 18 is positioned at the center of the bending base 16. The cross section of each bending groove 18 is formed so that the outer side is deep and the inner side is shallow as shown in FIG. 4. Consequently, by means of these bending grooves 18, the respective lower ends of the leg parts 3 of the corner clip 1 are bent while delineating a gentle arc shape, and are made to protrude diagonally upward so that the respective tips of the leg parts 3 are brought in a direction to contact with one another. A pair of guide plate members 19 which are made of metallic or synthetic resin plates are attached onto the cover 17. This pair of guide plate members 19 are positioned so that their inner sides align with the lines extending from the outer sides of the respective bending grooves 18 to form a rightward-turned V-shape which is widen toward the right but lacks its apex as shown in FIG. 5. By inserting the corner part of the documents into between these guide plate members 19, one can position the tip of the corner part of the documents at the apex of the bending grooves 18. Since the leg parts 3 of the corner clip 1 are not positioned at the apex part of the bending grooves 18, alternatively, it is also acceptable to form the bending grooves 18 so that these two mutually slanting grooves 18 do not quite meet at the top or apex as they do in the illustrated embodiment where they intersect together at right angle, but they form an approximate rightward turned V-shape which is widen toward the right in FIG. 5 but lacks its apex port.

As shown in FIGS. 3 and 4, the handle 13 is composed from a handle body 21, and a forward head part 22 which is attached to the handle body 21 so that the rear end of the forward head part 22 engages the inside of the forwardmost part of the handle body 21. Both the handle body 21 and the forward head part 22 are made from a metallic plate material, and each of their cross sections is formed into approximately an inverted U-shape opened at the lower end. A support pin 24 and a pivot pin 25 are provided so as to traverse the front parts of two side parts 23 of the handle body 21. Similarly, a crank support pin 26 is provided so as to extend between the two side parts 23 at a rear part away from the pivot pin 25. Between two side parts 27 of the forward head part 22, as well, there extends a support pin 28 and a pivot pin 29 which constitutes the rotating fulcrum of this forward head part 22. With regard to the forwardmost area of the forward head part 22, an opening formed by the two side parts 27 is blocked by a frontal plate 31. A butterfly nut 32 is supported in a rotatable manner at the central part of this frontal plate 31 of the forward head part 22, and a screw shaft 33 is screwed into the butterfly nut 32. One end of a coil spring 34 is attached to the rear end of this screw shaft 33, while the other end of the coil spring 34 is attached to the support pin 24. This coil spring 34 functions to return the handle body 21 to the position shown in FIGS. 3 and 4 after the handle body 21 is turned clockwise or downward from the illustrated position around the pivot pin 25 acting as the rotating fulcrum. By adjusting the extension of the coil spring 34 by changing the position of the screw shaft 33 using the butterfly nut 32, one can adjust the return force of the handle body 21.

The support frame 14 is constituted by a first frame 41 which is fixed to the front end side of the central base 15, a second frame 42 which is attached to the rear end of this first frame 41, and a third frame 43 which is attached so as to cover this second frame 42. These frames are also made of metallic plate.

Figure 6:
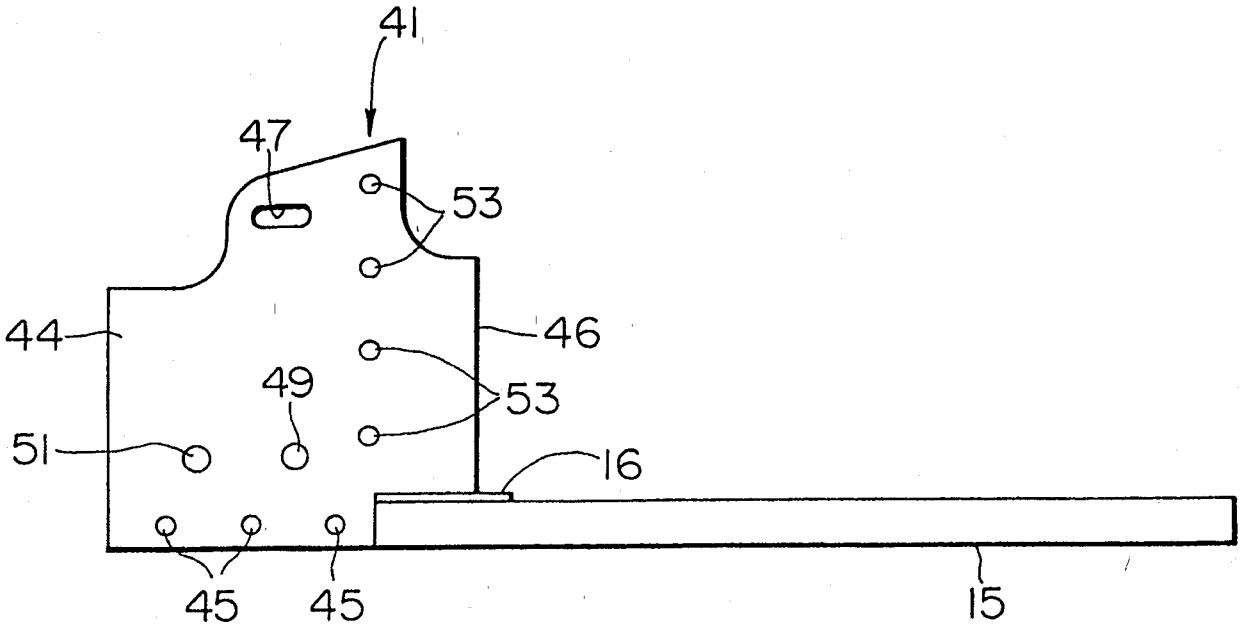
FIG. 6 is a front view showing only the substrate part and a first frame of the corner clipping apparatus of FIG. 3.
Figure 9:
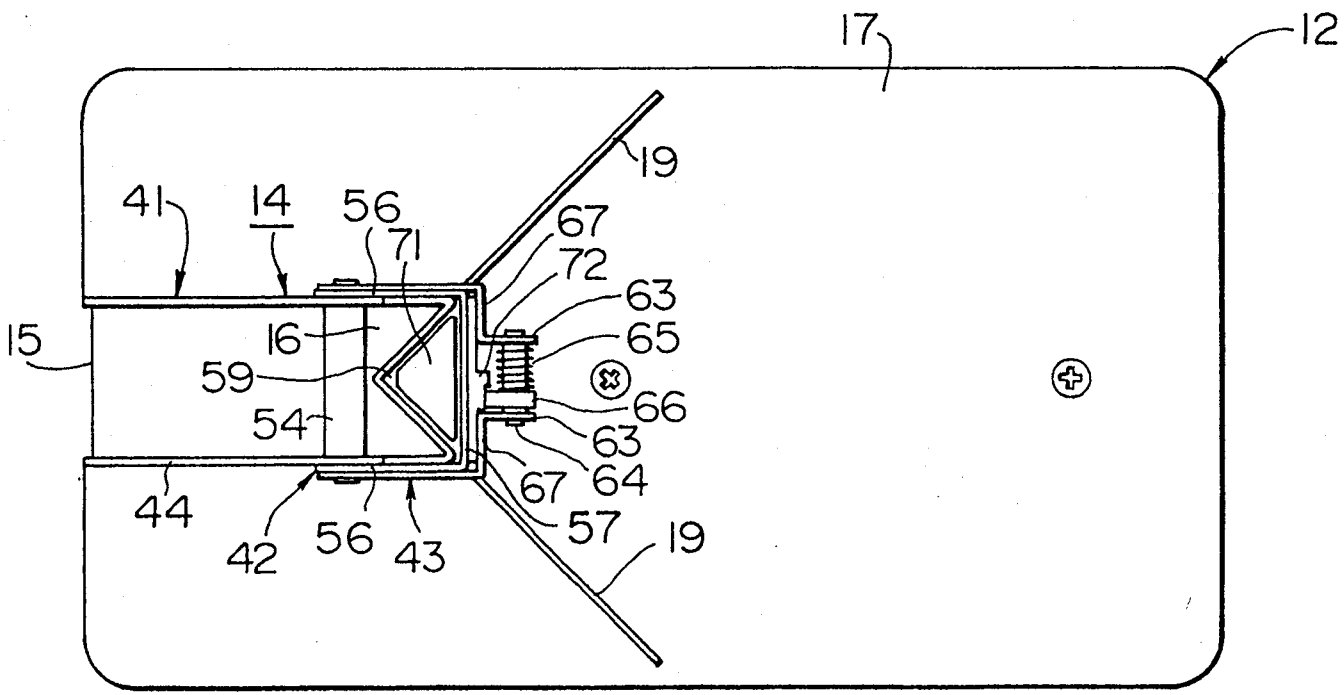
FIG. 9 is a cross sectional view showing a state where the substrate part, and the first, second, and third frames are assembled into one body.

First, the first frame 41 will be described with reference to FIGS. 4, 6 and 9. The first frame 41 has two side parts 44, the respective lower ends of which are fixed by means of three fixing pins 45 to the front end part of the central base 15, and has a rear end part 46 which is bent to form an M-shaped section. The M-shaped part of this rear end part 46 is positioned above the outer sides of the bending grooves 18. With regard to the respective upper end parts of the two side parts 44, their forward end sides are made lower in height so as not to impede the displacement of the support pin 28 in the horizontal direction, while cut parts are formed in their rear end sides so as not to impede the descent of the pivot pin 25. At the respective upper end parts of the two side parts 44, horizontally elongated holes 47 are formed so that the pivot pin 29 is loosely fitted in the elongated holes 47. Thus, even though a force inclined relative to the horizontal direction is exerted to the forward head part 22 of the handle 13 due to the descent of the handle body 21, the forward head part 22 can still move horizontally by the cooperation of the elongated hole 47 and the point pin 49. The upper end of a crank member 48 is attached in a freely rotatable manner to the pivot pin 29 between the two side parts 44, and the lower end of the crank member 48 is attached similarly in a freely rotatable manner to a support pin 49 which extends between the two side parts 44. The crank member 48 is designed to conduct control so that the forward head part 22 does not rise above a predetermined level as a result of the descent of the handle body 21. A support pin 51 is provided to extend between the two side parts 44 on the front end side thereof, and a coil spring 52 is attached between the support pin 51 and the support pin 28. This coil spring 52 is designed to normally urge the forward head part 22 resiliently downwards. At a side of the rear end 46, four support pins 53 are placed at equal intervals in the vertical direction so as to extend between the two sides. In order to ensure the passage of each of these support pins 53, a reinforcing plate member 54 designed to reinforce the first frame 41 is inserted and fixed between the side parts 44.

Figure 7:
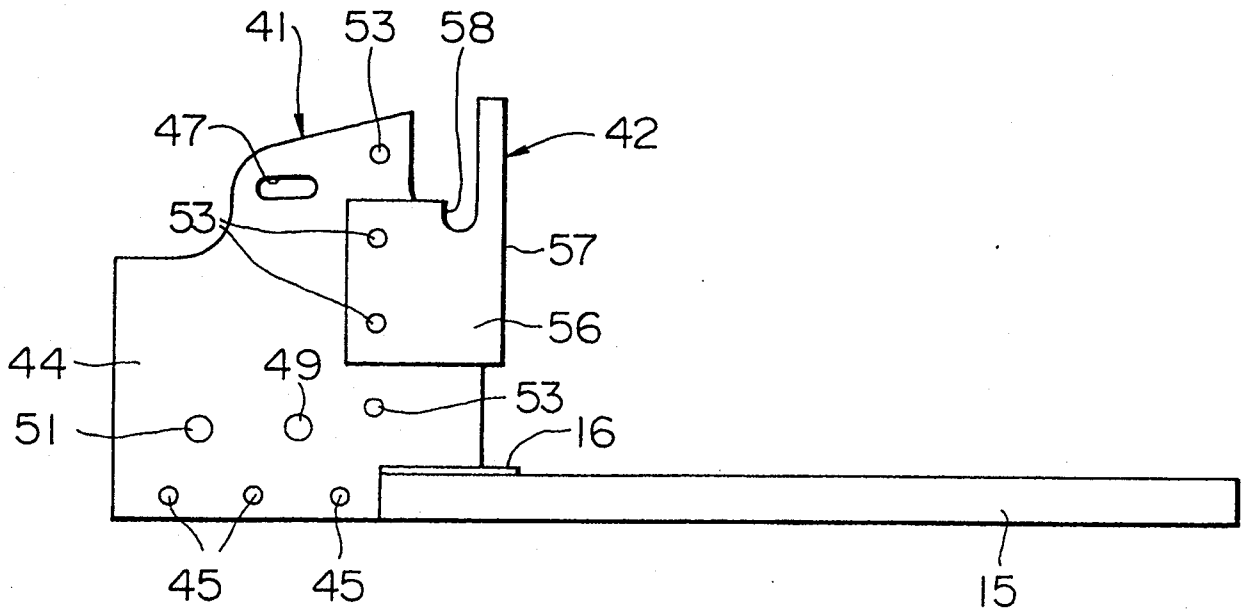
FIG. 7 is a front view showing a state where a second frame is further attached in the state of FIG. 6.

Next, the second frame 42 will be described with reference to FIGS. 4, 7 and 9. The second frame 42 having an approximately U-shaped cross section is constituted by two side parts 56 and an end face part 57 which covers the rear end opening between these two side parts 56. The respective rear end sides of the two side parts 56 are higher than the front end sides, and the respective front end sides of the two side parts 56 are fixed to the two side parts 44 of the first frame 41 by means of the second and third pins from the top of the support pins 53. A guide groove 58 which is open at its top is formed at the rear end side of each of the two side parts 56. The end face part 57 of the second frame 42 and the M-shaped rear end part 46 of the first frame 41 define a triangular channel 59 therebetween as shown in FIG. 9.

Figure 8:
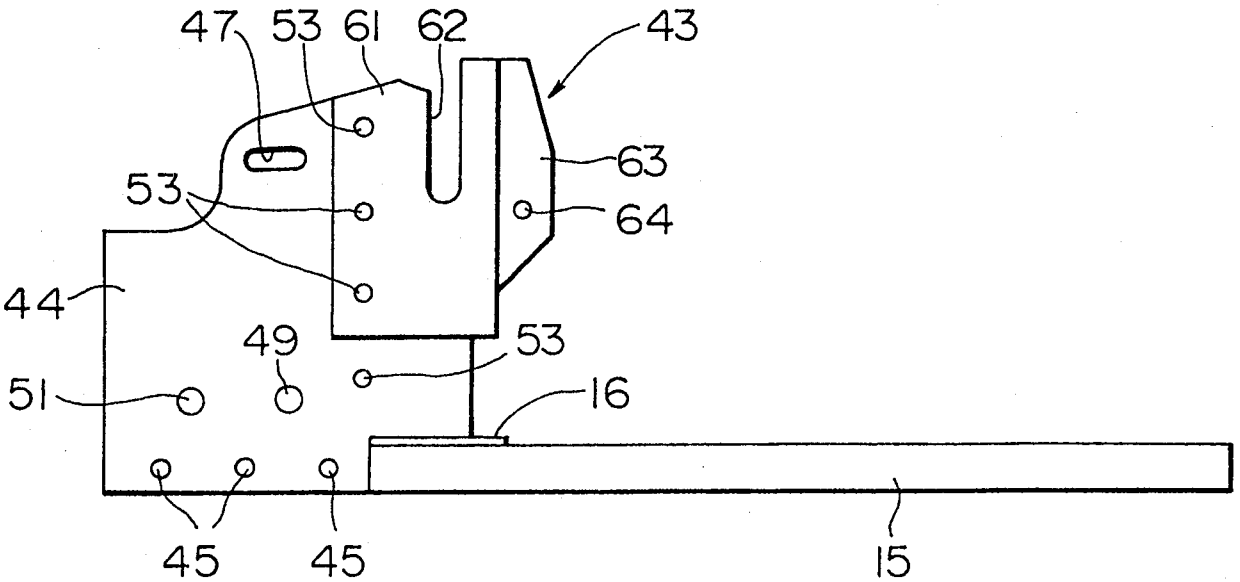
FIG. 8 is a front view showing a state where a third frame is further attached in the state of FIG. 7.

The third frame 43 will be described with reference to FIGS. 4, 8 and 9. The third frame 43 is constituted by two frame plates 61 which are positioned interpose the two side parts 56 of the second frame 42 therebetween. Since the frame plates 61 are completely identical in form to each other, the following description will concern the frame plate 61 of one side. The front end part of the frame plate 61 is fixed to the side part 56 of the second frame 42 by upper three pins of the support pins 53. The frame plate 61 is higher than the side part 56 of the second frame 42, and is approximately the same height as the side part 44 of the first frame 41; the front end part of the frame plate 61 is approximately the same height as the front end part of the second frame 42. A guide groove 62, which aligns with the guide groove 58, is formed on the frame plate 61. The rear edge part of the frame plate 61 is cranked, and an edge part 63 faces another edge part 63 of the frame plate 61 of the other side at a predetermined interval. As shown in FIG. 9, a support pin 64 extends between the respective edge parts 63 of the frame plates 61. A coil spring 65 and a claw member 66 of synthetic resin are inserted on the support pin 64, the claw member having a thickness to move between the edge parts 63. The coil spring 65 positions the claw member 66 as shown in FIG. 9 at normal times and at the same time resiliently urges the tip end of the claw member 66 against the end face part 57 of the second frame 42. An end face part 67 of the frame plate 61 which is formed in a cranked manner is arranged so that there can be a space between its rear side and the front side of the end face part 57 of the second frame 42.

As a result of this configuration, an approximately triangular channel 59 is formed between the end face part 57 of the second frame 42 and the M-shaped rear end part 46 of the first frame 41. In this channel 59, a hammer member 71, which is tabular in shape and triangular in horizontal cross section, is inserted freely vertically movably. The pivot pin 25 is inserted through the upper end part of the hammer member 71. As the handle body 21 descends, this hammer member 71 also descends, and when the handle body 21 reaches its lowest point of descent, its bottom end surface strikes the bending base 16. The hammer member 71 is also made of metallic material.

Figure 10:
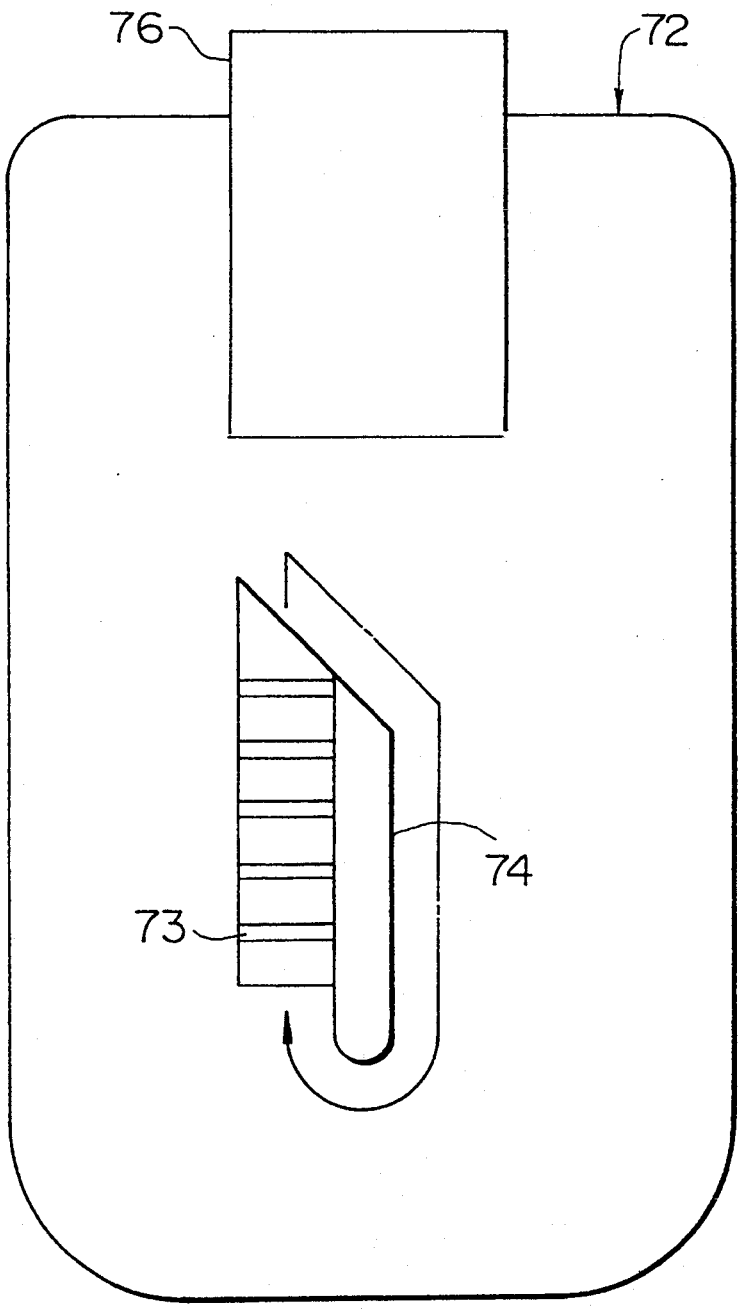
FIG. 10 is a plan view showing only an adjustment plate of the corner clipping apparatus of FIG. 3.
Figure 11:
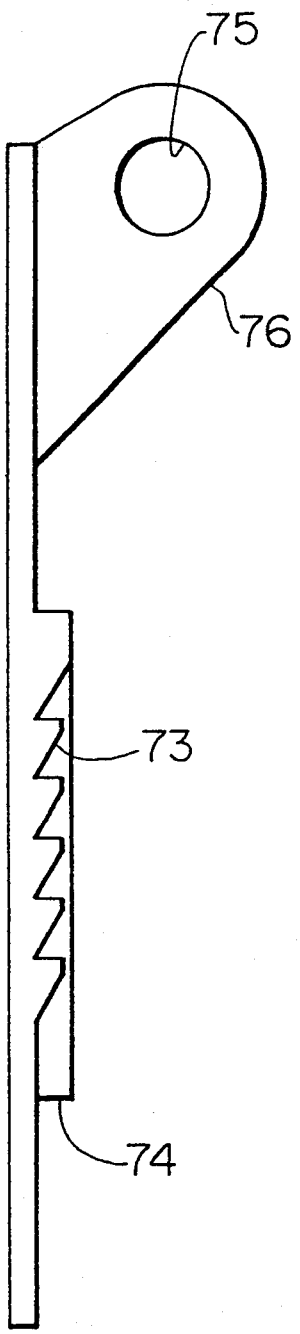
FIG. 11 is a side view the adjustment plate of FIG. 10.
Figure 12:
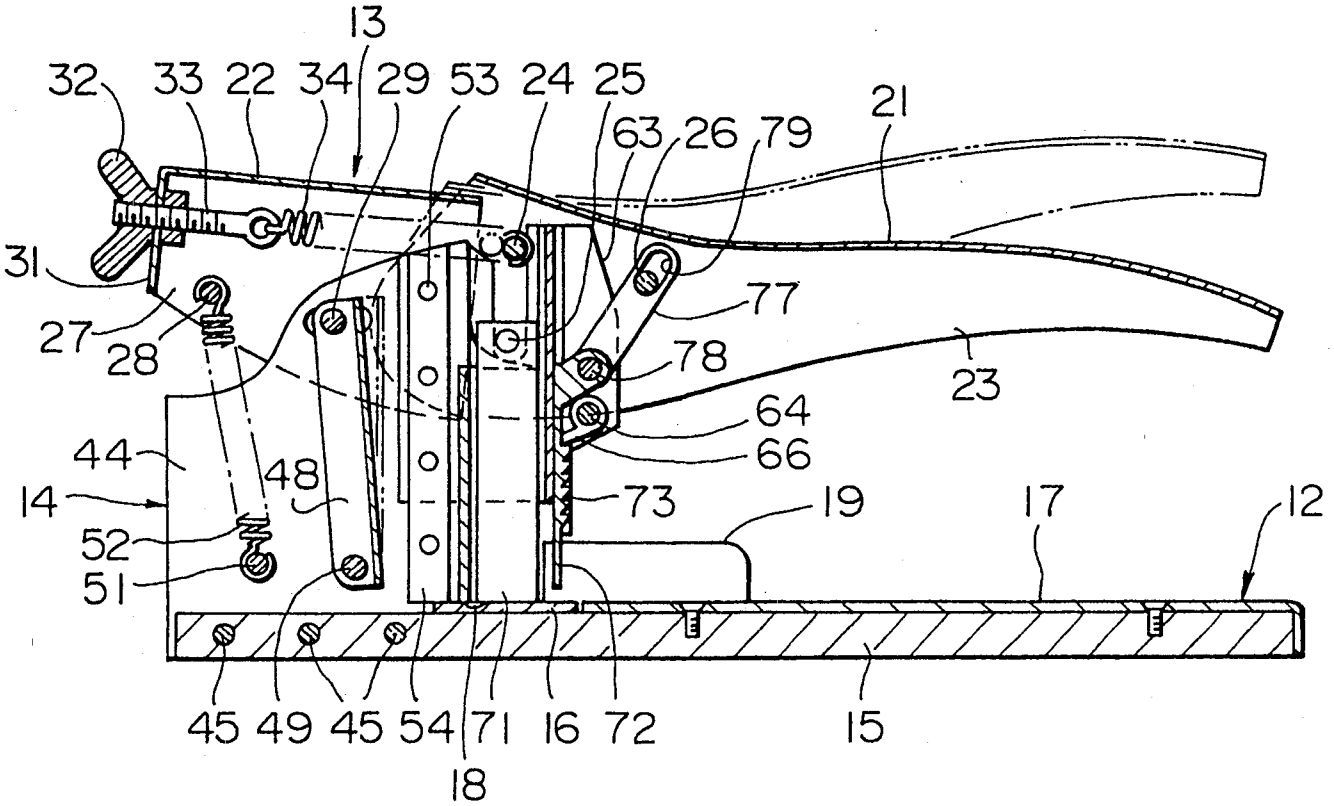
FIG. 12 is a vertical sectional view of showing the state where the handle of this corner clipping apparatus has been lowered.

Such an adjustment plate 72 of synthetic resin as shown in FIGS. 10 and 11 for adjusting the descent of the handle body 21 is vertically movably inserted in the gap between the end face part 67 of the frame plate 61 and the end face part 57 of the second frame 42. On the left side part of one face of this adjustment plate 72 shown in FIG. 10, there is formed a rack part 73 which projects out from the surface so as to engage with the tip of the claw member 66, and a guide edge 74 which is inclined diagonally downward from the top end of this rack part 73, which passes along the right side edge of the rack part 73, and which reaches the bottom end of the rack part 73. The teeth of the rack part 73 are formed so that, when the tip of the claw member 66 is engaged, the lowering of the claw member 66 or the raising of the adjustment plate 72 is prevented. At the top of the adjustment plate 72, a fastener 76 is integrally provided in which an pin hole 75, which is parallel to the surface of the adjustment plate 72, is formed. A support pin 78, which supports a lower end of a crank 77 in a freely rotatable manner, is inserted through this pin hole 75. An elongated hole 79 is formed at the upper end of the crank 77, and the pivot pin 26 is inserted through this elongated hole 79.

Figure 13:
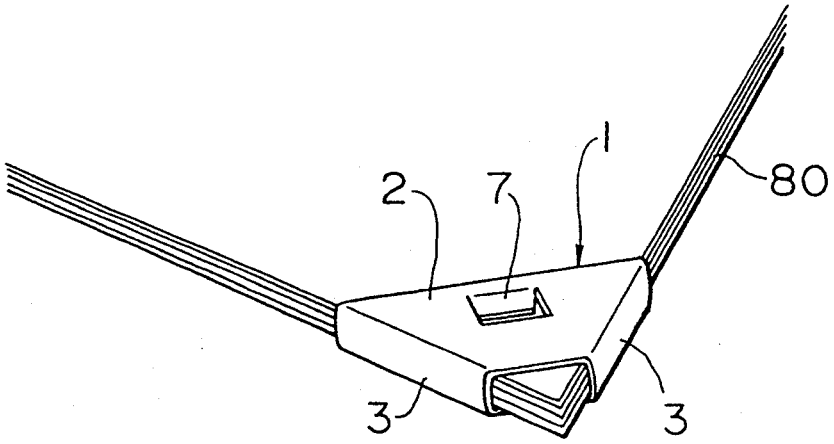
FIG. 13 is a perspective view showing the state where the documents are bound by the corner clip.

Next, the operations in the case where a corner part of documents 80 is bound as in FIG. 13 by the corner clipping apparatus 11 of the above configuration will be described below. In the state where no pressure is applied to the handle body 21, the handle body 21 is positioned as shown in FIGS. 3 and 4. In this state, the corner part to be bound of the documents 80 is pushed fully inward along the guide plate member 19. As a result, the corner part of the documents 80 is positioned on the bending grooves 18 of the bending base 16. Next, the corner clip 1 is inserted onto these bending grooves 18 with its leg parts 3 underneath, and is positioned so that the edges of the corner part of the documents are interposed between the two leg parts 3.

In this state, when the handle body 21 is pushed down against the elastic force of the coil springs 34 and 52, the handle body 21 turns downward on the pivot pin 25 as a fulcrum. Since the hammer member 71 is attached to the pivot pin 25 and since the adjustment plate 72 is attached to the handle body 21 via the crank 77, when the pivot pin 25 enters the guide groove 62, the hammer member 71 and the adjustment plate 72 are caused to descend in conjunction with the turning of the handle body 21. Since the rack part 73 of the adjustment plate 72 is formed so that the tip of the claw member 66 can go over it, the descent of the adjustment plate 72 is not impeded by the claw member 66. On the contrary, since the rack part 73 engages with the claw member 66 and prevents the ascent of the adjustment plate 72 when one's hand releases the handle body 21 in a state where the amount of descent of the handle body 21 is insufficient, the handle body 21 does not ascend to its initial state. When the handle body 21 is lowered to the point where the claw member 66 is positioned at the upper end of the rack part 73, the claw member 66 separates from the rack part 73 against the urging force of the coil spring 65 and engages with the guide edge 74, and the handle body 21 descends further. The bottom part of the hammer member 71 which has descended together with the handle body 21 strikes the substrate part 2 of the corner clip 1, causing the corner clip 1 to descend. Due to the descent of the corner clip 1, the lower ends of the leg parts 3 enter the bending grooves 18 of the bending base 16, and are bent along the contour of the bending grooves 18, and their lower ends protrude so as to push against the rear side of the bottommost document 80. After the handle body 21 has been fully pushed down in this manner, when one releases one's hand, the claw member 66 is positioned by the guide edge 74 to the right side of the rack part 73 in FIG. 10. Consequently, the ascent of the adjustment plate 72 also becomes possible, and the handle body 21 can be raised by the coil springs 34 and 52 back to the initial state shown in FIGS. 3 and 4.

If the documents 80 are taken out from the corner clipping apparatus 11, the corner clip 1 will be diagonally positioned on their corner part. Accordingly, one can flip to open the documents 80 using the rear end part 5 of the corner clip 1 as a guide, and not only is it easy to open the pages, but the photocopying of documents from among these pages can be conducted very easily. As was stated above, due to the claw member 66 and the adjustment plate 72, in a state where the amount of descent of the handle body 21 is insufficient, the handle body 21 does not rise back to its initial state even if one's hand releases the handle body 21. Consequently, the clipping operation cannot be terminated in a state where the leg parts 3 are not sufficiently bent, and clipping errors can be prevented.

Figure 14:
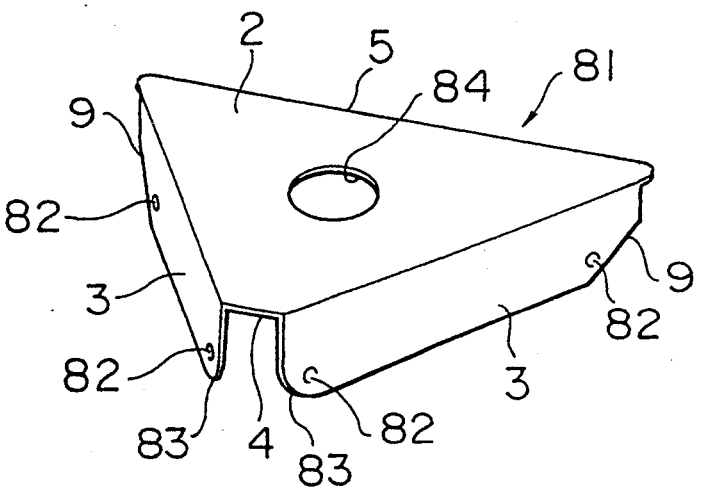
FIG. 14 is a perspective view showing another embodiment of the corner clip according to the present invention.
Figure 15:
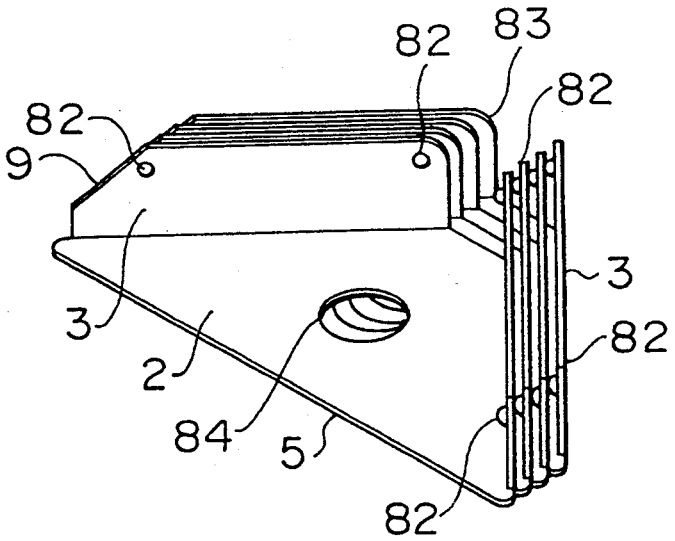
FIG. 15 is a perspective view seen from the bottom which shows the state where a plurality of those corner clips have been collected.

Next, another embodiment of the corner clip will be described with reference to FIGS. 14 and 15. With regard to those structural elements which are substantially identical to the above-mentioned corner clip 1, the same reference numbers are applied, and their description is here omitted. In a corner clip 81 of this second embodiment, two protrusions 82 are formed with an interval between them on each leg part 3 in the horizontal direction by embossing. These protrusions 82 protrude to the back face of the leg parts 3, that is, toward a substrate part 2. The height of each protrusion is about 0.5 mm from the back face of the leg parts 3. Moreover, in this embodiment, the corner part of each leg part 3 on the short edge 4 side is cut into a curved shape to form a circular arc part 83. In addition, an aperture 84 is established at the center of the substrate part 2.

Accordingly, in the case where the corner part of the documents is bound by this corner clip 81, since the corner part of the documents is held between the substrate part 2 and the leg parts 3, and since the documents are pressed by the protrusions 82, a stronger holding force can be obtained. Moreover, as shown in FIG. 15, when a plurality of corner clips 81 are piled to place one on top of the other, a gap - in this embodiment a 0.5 mm gap - can be created by these protrusions 82 between the respective leg parts 3 of every two adjacent corner clips 81 which are positioned adjacent to each other. As a result, there does not occur any problem involving the sealing of the leg part 3 with the leg part 3 of the corner clip 81 positioned on the inside and the inability to separate them, and they can be easily separated. Furthermore, with regard to the aperture 84, it is possible to pass a string through the documents 80 and the aperture 84 so that the documents 80 are suspended by means of this string. In this case, the documents do not tear off from the string part.

In the foregoing, the present invention has been described with reference to suitable embodiments, but these embodiments are only for purposes of understanding the present invention, and various alterations or modifications are possible so long as the present invention does not deviate from the below claims.

What is claimed is:

1. A combination of a corner clip and a corner clipping apparatus for binding a corner part of documents by using the corner clip, said corner clip being made from a strip of bendable metallic material with a predetermined width and including an approximately trapezoidal substrate part and a pair of leg parts which are bent at approximately right angles from the pair of mutually slanted edge parts of this substrate part, wherein when these leg parts are applied to outer edges of a corner part of documents and said leg parts are bent, said corner clip can hold said corner of said documents between said leg parts and said substrate part, said corner clipping apparatus including:

a base having a pair of guide plate members for positioning said corner part at an approximately central part between said pair of guide plate members, and a pair of bending grooves positioned near top ends of said pair of guide plate members for bending said leg parts in the direction so that said leg parts contact with each other;

a hammer member having a cross section so that said hammer member comes into face-to-face contact with said substrate part of said corner clip;

a frame member attached on said base for supporting said hammer member so that said hammer member is vertically movable to and from said bending grooves; and a handle rotatably attached to said frame member for vertically moving said hammer member, so that the leg parts of said corner clip are bent along said pair of bending grooves by means of said hammer member.

2. A combination according to claim 1, in which said corner clipping apparatus further includes an adjustment means for preventing said handle from turning upward at times when said handle is not sufficiently turned downward to a position where said hammer member bends said leg parts of said corner clip.

3. A combination according to claim 2, in which said adjustment means includes a rack member attached to said frame member and a claw member movable vertically in conjunction with turning of said handle, said claw member being arranged so that said claw member engages with said rack member when said handle is turned down to a predetermined position, while said claw member is disengaged from said rack member when said handle is turned down to said position where said hammer member bends said leg parts of said corner clip, said claw member preventing said handle from turning upward when said claw member is engaged with said rack member.

4. A combination according to claim 3, in which said claw member is movably attached onto said handle so that said claw member is disengaged from said rack member when said handle is turned down to said position where said two leg parts of said corner clip are bent, subsequently said claw member moves to a side edge side of said rack member, and then said claw member positions just above said rack member when said handle is turned upward to its initial position.

5. A corner clip for holding materials, said corner clip being made of a bendable metal plate and comprising, a substrate part having front and rear side edges arranged parallel to each other and slanted edge parts disposed diagonally to the front and rear side edges to thereby form a trapezoidal shape, said substrate part having a cut portion in a middle of the substrate part and a projection projecting from the cut portion in a direction away from a surface of the substrate part to form a fastener, and a pair of leg parts integrally formed with the substrate part and extending at substantially right angle from the slanted edge parts in a direction as in the projection, each leg part having a slanted lateral edge at a side of the rear edge part so that when the leg parts are placed at a corner part of the materials and are bent inwardly toward the substrate part, the leg parts are located on the substrate part without protruding sidewardly from the substrate part and the corner part is held between the leg parts and the substrate part while securely engaging the projection.

6. A corner clip according to claim 5, wherein said clip consists of the substrate part and the two leg parts.

7. A corner clip for holding materials, said corner clip being made of a bendable metal plate and comprising, a substrate part having front and rear side edges arranged parallel to each other and slanted edge parts disposed diagonally to the front and rear side edges to thereby form a trapezoidal shape, and a pair of leg parts integrally formed with the substrate part and extending at substantially right angle from the slanted edge parts, each leg part having at least two protrusions at corner portions away from the substrate part so that when the leg parts are applied to a corner part of the materials and are bent inwardly toward the substrate part, the corner part is held between the leg parts and the substrate part while securely engaging the protrusions.

* * * * *